United States Patent [19]

Patterson

[11] 4,111,427

[45] Sep. 5, 1978

[54] SPACE TRAVEL GAME

[76] Inventor: Nelson Patterson, 1385 Ashland Ave., Des Plaines, Ill. 60016

[21] Appl. No.: 801,762

[22] Filed: May 31, 1977

[51] Int. Cl.[2] ..... A63F 3/00

[52] U.S. Cl. ..... 273/250

[58] Field of Search .... 273/134 AA, 134 E, 134 AD, 273/134 C, 134 AT, 134 GP, 134 AC, 134 BD

[56] References Cited

U.S. PATENT DOCUMENTS

| | | | |
|---|---|---|---|
| 3,433,483 | 3/1969 | Ellis | 273/134 AD |
| 3,658,337 | 4/1972 | Peters et al. | 273/134 AC |
| 3,936,054 | 2/1976 | Garcia | 273/134 E |
| 3,985,361 | 10/1976 | Millen | 273/134 E |

FOREIGN PATENT DOCUMENTS

| | | | |
|---|---|---|---|
| 15,223 of | 1907 | United Kingdom | 273/134 AC |
| 915,550 | 1/1963 | United Kingdom | 273/134 AC |

*Primary Examiner*—Richard C. Pinkham
*Assistant Examiner*—Harry G. Strappello
*Attorney, Agent, or Firm*—Leo J. Aubel; Gerald T. Shekleton

[57] ABSTRACT

A space travel game with game board having a primary path of movement and auxiliary paths connected with the primary path. A spinner apparatus is divided into numbered pie-shaped wedges of alternating colors and controls the amount and direction of travel. The paths comprise interconnected series of blocks, the blocks being grouped into alternating series of different colors. The pointer of the spinner indicates the number of blocks to be traveled and the color of the path to be taken upon reaching an intersection of a primary path with an auxiliary path. Game pieces shaped in the form of spaceships, different groups of cards, and a separate chance control device are involved in the playing of the game.

4 Claims, 11 Drawing Figures

SPACE TRAVEL GAME

The present invention relates in general to a game device and, more particularly, to a game board with associated playing pieces, game cards and change devices.

SUMMARY OF THE INVENTION

The subject game includes a game board having a plurality of paths on which spaceship tokens may travel in simulated rescue missions to the planet Terra. Situated at spaced intervals on each of these paths are segmented areas or squares designating various fates of space travel which may befall a player. In traversing each of the different paths, a player may land on conflict squares, space warp squares and planet squares. Upon landing on any of these particular squares the player will draw the appropriate card and follow the instructions on that card. The distance travelled on the paths in each player's turn is governed by a unique spinner structure. The paths are colored in different hues corresponding to different colors on the spinner to direct the player to which path he should take and how far he should go on that path. When landing on a conflict square, a player must go to a conflict board and accept varying degrees of risk in determining the events which are to take place.

In general, the object of the game is, as already stated, to supply a rescue or relief mission to the planet Terra. The planet Terra is in the solar system of Sol II which is entering the nova stage in the life of a star, thereby endangering all life on Terra. Terra has lost all of its spaceships and material for building new spaceships, both having been stolen by neighboring planets for their own escape. The participants in this game must risk the hazardous journey to Terra through the above described paths to supply spaceships and a means of escape for the people of Terra. The participant arriving at Terra with the largest number of spaceships wins.

Another object of the subject invention is the provision of an entertaining and challenging game with a futuristic space theme.

DESCRIPTION OF THE DRAWINGS

Further objects of the invention, together with additional features contributing thereto and advantages accruing therefrom, will be apparent from the following description of one embodiment of the invention when read in conjunction with the accompanying drawings wherein:

Referring to FIG. 1 there is shown a game board 15 comprising a plurality of discrete steps or positions 12 which form a number of paths along which spaceship tokens 16 may travel. These paths begin at one or more launch pad positions 31 and 32 and continue through a main or primary meandering path having various offshoots or auxiliary paths until the end point or the planet Terra 30 is reached. Each point of intersection of the primary path with an auxiliary path divides the paths into segments, each of which is identifiable through color, alternative segments being of different colors. A yellow auxiliary path as at 21, indicates a safety zone. A purple primary path would indicate that a player continues forward until the spinner 40 indicates the color of an auxiliary path which is crossed. Red and blue paths 13 and 14 are related to the spinner colors, and control direction of travel as will be explained.

Figure 2:
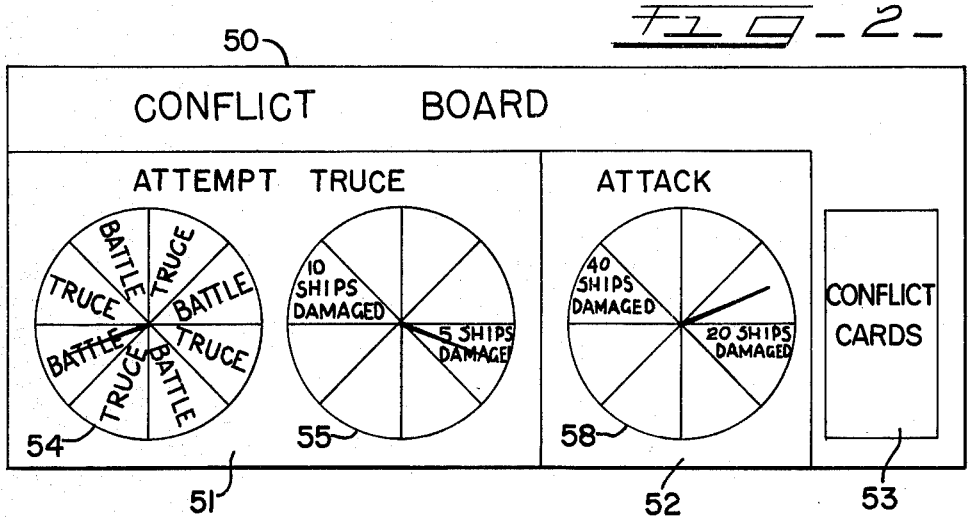
FIG. 2 is a plan view of the conflict board employed in the subject inventive game.
Figure 3:
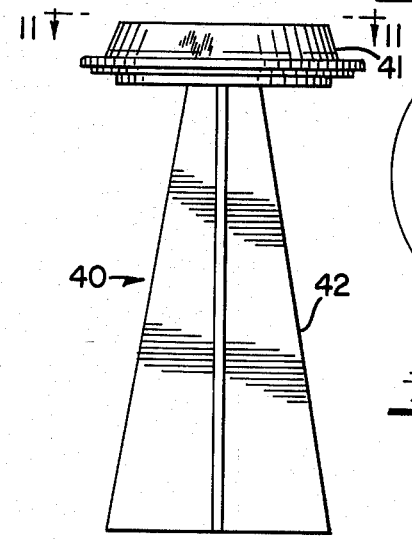
FIG. 3 is a side view of the spinner device of the subject invention showing its means of support.

Each of these discrete positions or steps may contain instructions such as at 33: "10 ships report back to base", or "Meteorite shower, 25 ships damaged". Other squares or positions 12 include a fuel station square as at 19, which a player may exchange monetary units for spaceship fuel. Safety zones 21 are found on the board through which the player may pass without incurring any risk of damage or destruction. Space warp squares 22 are identifiable through the spiral design superimposed on the square. Upon landing on this space warp square 22, the player's ship token is transferred to the interior section 25 of the board for a fate to be described below. Planets are indicated as circles 20 on the board 15, and, in one embodiment, named with the letters of the Greek alphabet. Landing on a planet 20 allows a player to draw a planet card 47, described below, at which time the player follows the instructions on the card. Conflict squares 24 are indicated by an abstract design. Upon landing on such a square 24, the player must utilize the conflict board 50 of FIG. 2, described below.

Figure 11:
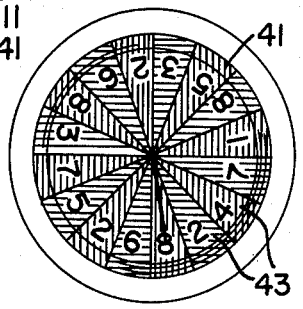
Figure 7:
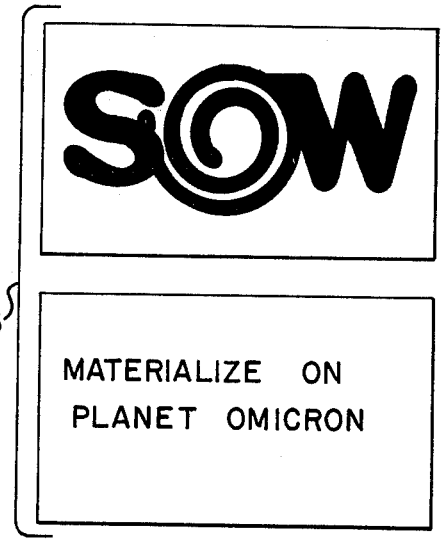
FIG. 7 is a plan view of both sides of a space warp card employed in the subject inventive game.

A unique spinner structure 40 governs the travel of the players in both direction and distance (FIG. 11). This spinner structure 40 has a circular face which is divided into radially positioned pie-shaped segments, each having randomly arranged numbers 1 through 8. The face 41 of the spinner structure 40 is supported on a pedestal 42 giving it a distinctive appearance. The pie-shaped segments 43 of the spinner face 41 are of alternating color and, in the preferred embodiment, blue and red correspond to the blue and red of the paths. Thus, when a player spins on his turn, the number to which the spinner points will identify the distance to be travelled and the color of the segment will identify the color of the path which he is to take, if there is an alternate route of that color.

Figure 9:
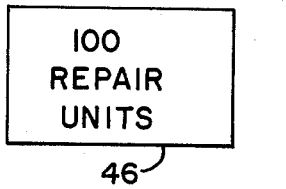
FIG. 9 is a plan view of one of the monetary units used in the subject inventive game.
Figure 5:
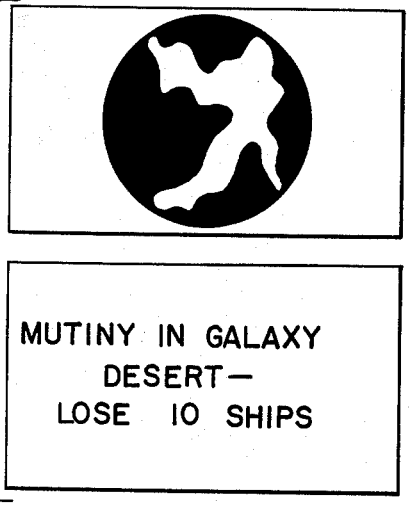
FIG. 5 is a plan view of opposite sides of a planet card employed in the subject inventive game.
Figure 10:
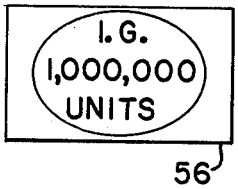
FIG. 10 is a plan view of another of the monetary units used in the subject inventive game; and, FIG. 11 is a plan view taken along the line 11—11 of FIG. 3 showing in detail the spinner display face.

The monetary system in use in the subject invention involves Repair Units 46 (FIG. 9) and InterGalactic Units 56 (FIG. 10), both of varying denominations.

The cards used when landing on the various respective spaces include Space Warp cards, Conflict cards and Planet cards. As already explained, when landing on a planet 20, a planet card is drawn. This planet card 47 will describe an event and the resulting fate of the player. For instance, "Sirius meteorite shower — exchange 1 million InterGalactic units for 200 repair units," or "Parallel Zone — trade places and ships with any other player on board."

The space warp cards 45 are used when the player has entered the space warp section 25 of the game board 15. Upon landing on a space warp square 26 within the space warp section 25, a player draws a space warp card 45 and follows the instructions on such card. Examples of these instructions are: "Materialize on Planet Omega," "Materialize on any planet" and "Materialize at Launch Base Blue".

Figure 8:
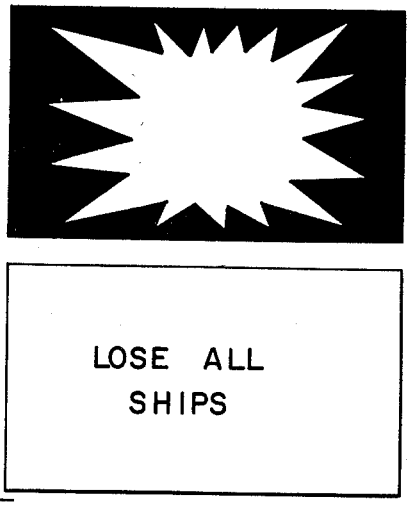
FIG. 8 is a plan view of a conflict card employed in the subject inventive game.

Conflict cards 53, shown in FIG. 8, are used when landing on a conflict square 24 on the game board 15. These conflict cards are one of three choices which may be selected for use in conjunction with the conflict board 50, to be explained, and represent the highest risk move that a player may take on the conflict board. These conflict cards will inform a player that the results of the battle were "100 enemy ships captured", "25 fleet ships damaged" or "Diversionary tactic-escape to any safety zone".

Figure 6:
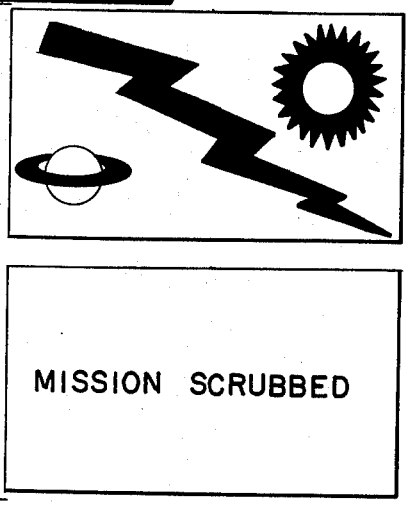
FIG. 6 is a plan view of opposite sides of an emergency card employed in the subject inventive game.

Emergency cards 48, shown in FIG. 6, are drawn in the event that a player loses all of his ship tokens 17. These emergency cards 48 will instruct the player as to his next more, for instance: "Report to planet Beta — receive 125 ships"; "Report to any safety zone and receive 50 ships."

Figure 1:
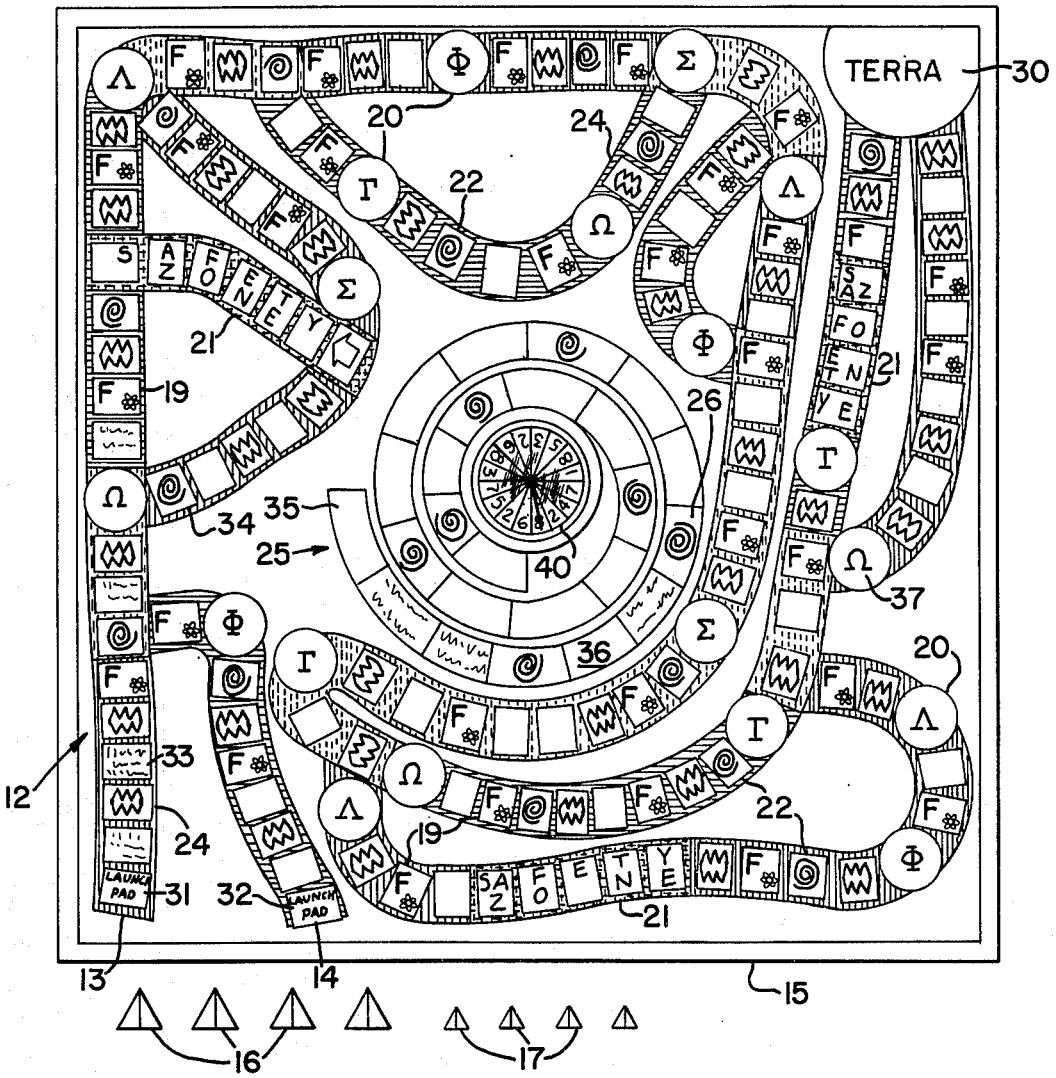
FIG. 1 is a plan view of the game board of the subject invention illustrating the paths of movement thereon and having a spinner structure at its center.
Figure 4:
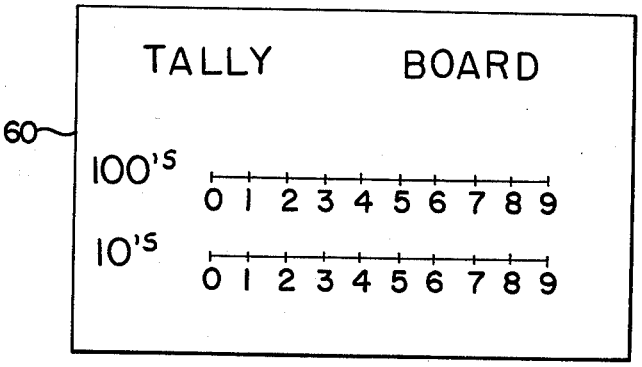
FIG. 4 is a plan view of the tally board employed in the subject inventive game.

The game pieces 16 and 17 are shaped in the form of spaceships (FIG. 1), having a delta wing-span although obviously various other forms may be used. The larger tokens or playing pieces 16 are designated command ships while the smaller tokens or playing ships 17 are fleet or board ships. Score of the number of ships possessed by one player is kept on a Tally Board 60 (FIG. 4) where up to nine hundred ninety board ships 17 may be recorded. The total number of ships in a player's possession are the sum of the number shown on the Tally Board 60, the board ships 17 in the player's possession, and the command ship 16. Thus, at the start of the game, a player may have 25 board ships 17 and 125 more board ships in reserve, shown on the Tally Board 60, totaling 150 fleet ships.

In playing the game of the subject invention, each of the players is issued a command ship 16, 150 fleet ships, a million InterGalactic units and 200 repair units. The command ships 16 are placed into the game board at either of Launch Pad Red 31 or Launch Pad Blue 32 to designate the order of playing. The spinner 40 is rotated by each of the players to determine the particular Launch Pad 31 or 32 on which he will start. The highest number obtained on the spinner 40 goes first and the next highest goes second. As already described, moves are governed by the number and color arrived at on the spinner 40. If a player should spin 3 for example, landing on space 33, he would follow the instructions which might state "Space debris — 25 ships damaged." He would have to put 25 of his ships aside. If the ships 17 are not repaired through the use of the appropriate number of repair units, they must be abandoned on the square where the damage took place. Thus, if the player did not have 25 repair units in his possession with which to repair the 25 damaged ships, those 25 ships must be abandoned and may be repaired by any other player subsequently landing on that square. Of course, the same player may later return with the repair units and reclaim his ships should they still be there and if the ships are abandoned where he can return.

On the player's next move, should the spinner 40 fall on a red 7, the player would land on a space warp square 35 of space game warp portion 25. This player continues taking his respective turns within the space warp portion, following the directions given on the space on which he lands. For instance, should his next turn indicate a travel of 4 spaces, he would land on space 35, which message might indicate "Oxygen leak — 20 ships damaged," in which case, he must, as before, either repair the ships with the appropriate number of repair units or abandon those ships on that square. Should the spinner indicate a travel of two spaces, on his next turn the player would land on square 26 whereupon he would draw a space warp card indicating that he should, for instance, "Materialize on planet Omega." His ship will then be transported to planet Omega where he continues to play.

Should a player land in the course of his travels on a conflict square, he then utilizes the conflict board 50 to determine his fate. Should he be a conservative player, he will choose to attempt a truce with Area 51 on the conflict board 50. The spinner 54 is operated first for selecting whether a truce will be negotiated or a battle will be fought. On an indication of a truce, the player does nothing further. If battle is indicated, spinner 55 is operated to determine the outcome of the battle.

However, if the player wishes to attack immediately when landing on a conflict square, he may take the attack option 52 and operate the spinner 58 where a larger risk is encountered. While the player risks a larger loss with the attack option 52, he may also emerge a stronger victor.

Should the player be one who is prone to take large chances, he may forego the truce option 51 and the attack option 52, and draw a conflict card 53 which presents the greatest risk of all, while awarding the greater number of ships to the player should he succeed in the attack.

When a player lands on a fuel station 19, he must refill the fuel tanks of each of his ships at the rate of one repair unit for 50 thousand InterGalactic units per ship. While on these squares, a player may also purchase ships and exchange InterGalactic units for repair units or exchange a maximum of five ships for repair units.

The object of the subject game is not to determine who can reach Terra first in time, but rather who can reach Terra with the biggest fleet of ships to aid in the rescue of the Terra people.

A player must, however, continually move forward following the directions given by the spinner color selector and avoiding a circling action. Further, when a card or instructional block indicates that a player must move to the nearest fuel station, planet, etc., the player must move his command ship 16 forward to that location. When the game is nearing an end and only one player is left on the board, he is to advance to the planet indicated at space 37 and from there proceed to Terra. Conflict cards may not be drawn if the player happens to land on a conflict square during his final moves.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. A space travel game wherein the winner is determined by a player arriving at an end point with the greatest number of game pieces, said game comprising a game board having a main path, a first playing portion, said main path being on said first playing portion, a plurality of auxiliary paths selectively connected to spaced points on said main path, said main path and auxiliary paths comprising a plurality of serially positioned blocks, each of said blocks having indicia thereon as instructions to a player, said blocks being grouped into alternating series, a first series being of a first color and a second series being of a second color, a spinner assembly having pie-shaped wedges radially disposed about the center of said spinner assembly, said wedges alternating between said first color and said second color whereby movement along said path is controlled by said spinner assembly, numbers associated with each of said wedges, said spinner assembly including a pointer, said pointer disposed for random movement to a position within one of said wedges, thereby indicating the number associated with that wedge as the number of spaces to be moved by the game pieces of each player during his turn, the color of said wedge indicating the direction of travel of said playing piece when said playing piece approaches one of said spaced points on said main path, a second playing portion, said second playing portion being reached by a player's game piece when said game piece falls on certain of said blocks, said game piece returning to said first playing portion when falling on one of said blocks in said second playing portion, whereby a player may gain or lose game pieces when landing on a particular block and following said instructions given thereon.

2. The space travel game of claim 1 wherein certain blocks of said plurality of serially positioned blocks indicate that upon movement of a playing piece to one of said certain blocks, a player must use a second spinner assembly to control the movement and number of game pieces possessed by said player.

3. The space travel game of claim 2 wherein said second spinner assembly includes a plurality of cards which may be selected to control the movements and number of game pieces possessed by said player.

4. The space travel game of claim 3 wherein other blocks of said plurality of serially positioned blocks instruct a player to draw a selected card to control said player's movements and the number of game pieces possessed by said player.

* * * * *